US007568863B2

(12) United States Patent
DeNardo

(10) Patent No.: US 7,568,863 B2
(45) Date of Patent: Aug. 4, 2009

(54) PANEL FORMS

(76) Inventor: Joseph N. DeNardo, 115 Links View Dr., McMurray, PA (US) 15317

( * ) Notice: Subject to any disclaimer, the term of this patent is extended or adjusted under 35 U.S.C. 154(b) by 170 days.

(21) Appl. No.: 11/787,476

(22) Filed: Apr. 17, 2007

(65) Prior Publication Data

US 2008/0016814 A1 Jan. 24, 2008

Related U.S. Application Data

(60) Provisional application No. 60/830,570, filed on Jul. 13, 2006.

(51) Int. Cl.
*E02D 29/02* (2006.01)

(52) U.S. Cl. ..... 405/285; 405/284; 405/114; 405/107; 405/31; 405/15

(58) Field of Classification Search ..... 405/114, 405/107, 284, 285, 21, 31, 15
See application file for complete search history.

(56) References Cited

U.S. PATENT DOCUMENTS

| | | | | | |
|---|---|---|---|---|---|
| 4,031,676 | A | * | 6/1977 | Dally | 405/114 |
| 4,269,545 | A | * | 5/1981 | Finney | 405/285 |
| 4,681,302 | A | * | 7/1987 | Thompson | 256/13.1 |
| 4,869,617 | A | * | 9/1989 | Chiodo | 405/114 |
| 5,134,815 | A | * | 8/1992 | Pickett | 405/285 |
| 5,360,296 | A | * | 11/1994 | Angelette | 405/285 |
| 5,453,287 | A | | 9/1995 | Close | |
| 5,538,363 | A | * | 7/1996 | Eastwood | 405/285 |
| 5,622,448 | A | * | 4/1997 | Baum et al. | 405/114 |
| 5,849,645 | A | | 12/1998 | Lancaster | |
| 5,921,709 | A | * | 7/1999 | Baum et al. | 405/114 |
| 6,059,491 | A | * | 5/2000 | Striefel et al. | 405/114 |
| 6,336,291 | B1 | | 1/2002 | Skuba | |
| D456,224 | S | | 4/2002 | Lancaster | |
| D456,674 | S | | 5/2002 | Lancaster | |
| D466,378 | S | | 12/2002 | Lancaster | |
| 6,658,790 | B2 | | 12/2003 | Skuba | |
| 6,859,983 | B2 | | 3/2005 | Curtis et al. | |
| 6,926,186 | B2 | | 8/2005 | Wells | |
| 2004/0111964 | A1 | | 6/2004 | Skuba | |
| 2006/0291963 | A1 | | 12/2006 | Theisen et al. | |

OTHER PUBLICATIONS

U.S. Appl. No. 07/852,429, filed Mar. 16, 1992.

* cited by examiner

*Primary Examiner*—Frederick L Lagman
(74) *Attorney, Agent, or Firm*—K&L Gates LLP

(57) ABSTRACT

In various embodiments, panel forms can be used to control erosion or retain dirt walls. Each panel form can be comprised of a substantially rigid body that is adapted to be mounted to the ground and can include connectors configured to receive mounts which mount the panel form to the ground. A plurality of panel forms can be used to form a fence, or a retaining wall, where the connectors extending from each panel form can be configured to mate and connect the panel forms together. In various embodiments, the mounts can be inserted through apertures in the mating connectors to provide a pivot about which the adjacent panel forms may be hingedly connected. In various embodiments, each panel form may include a tab extending therefrom which is configured to be received in a corresponding slot in the adjacent panel to reduce, or even eliminate, gaps between adjacent panel forms.

19 Claims, 11 Drawing Sheets

PANEL FORMS

PRIORITY

This application claims the benefit of U.S. Provisional Patent Application Ser. No. 60/830,570, entitled MUD CONTROL PANELS, filed on Jul. 13, 2006, the entire disclosure of which is hereby expressly incorporated by reference herein.

BACKGROUND

1. Field on the Invention

The present invention generally relates to panel forms and, more particularly, to panel forms which are mountable to the ground to control erosion, retain dirt walls, impede the flow of water, or form concrete edges, for example.

2. Description of the Related Art

In many circumstances, silt fences are erected to control the erosion of soil from a construction site, for example. Often, these silt fences are comprised of long, flexible woven sheets of material which are at least partly buried in the ground and are held in position by wooden stakes which are inserted through holes in the sheets and driven into the ground, for example. Usually, these silt fences are initially successful in controlling erosion; however, the sheets of material can become worn, tear, or lose shape after a period of time. Frequently, as a result, an entire sheet of material must be removed and replaced even though only a small portion of the sheet has been damaged. Once removed from the ground, these sheets of material are largely unreusable. Furthermore, these silt fences, as they are comprised of flexible sheets of material, are typically unable to retain large quantities of soil, mud, or water therebehind.

In many circumstances, woven sheets of material or, in some circumstances, sheets of plastic, such as Visqueen™ plastic membranes, for example, are draped over the sides of ditches, or trenches, for example, to prevent the walls of the ditch from caving in. However, as these sheets are flexible, dirt or mud may slide underneath, or displace, the sheets of material. In some circumstances, these sheets of material are draped over dirt walls surrounding the foundation of a building as it is being constructed. In these circumstances, similar to the above, dirt or mud can slide to the bottom of the foundation clogging the gravel footer drains therearound. If these clogged footer drains are not repaired, hydrostatic pressure may eventually build around the foundation of the building causing leaks and other damage to the building. What is needed is an improvement over the foregoing.

SUMMARY

In various embodiments of the present invention, panel forms can be used to control erosion or retain dirt walls, for example. In various embodiments, each panel form can be comprised of a substantially rigid body that is adapted to be mounted to the ground. In at least one embodiment, the panel forms can each include first and second connectors configured to receive mounts, or supports, which mount the panel forms to the ground. In various embodiments, a plurality of panel forms can be used to form a fence or a retaining wall. In these embodiments, the connectors extending from each panel form can be configured to mate with connectors extending from adjacent panel forms and connect the panel forms together. In at least one embodiment, the above-discussed mounts can be inserted through apertures in the mating connectors to mount the adjacent panel forms to the ground.

In various embodiments, these mounts may act as a pivot about which the adjacent panel forms may be hingedly connected. More particularly, in at least one such embodiment, after a mount has been inserted through the mating connectors of adjacent panel forms, the panel forms can be rotated relative to each other before they are mounted to the ground. Advantageously, in these embodiments, the shape of the fence or wall can be manipulated to achieve a desired configuration. In at least one embodiment, each panel form may include a tab extending therefrom which is configured to be received in a corresponding slot in an adjacent panel. In these embodiments, the cooperating tabs and slots can reduce, or even eliminate gaps between adjacent panel forms and, as a result, the fence or wall can be better suited to retain dirt, mud, and/or water therebehind. In at least one embodiment, the panel forms can be readily removed from the ground and rearranged into a different configuration.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention, in one form, and such exemplifications are not to be construed as limiting the scope of the invention in any manner.

DETAILED DESCRIPTION

Figure 1:
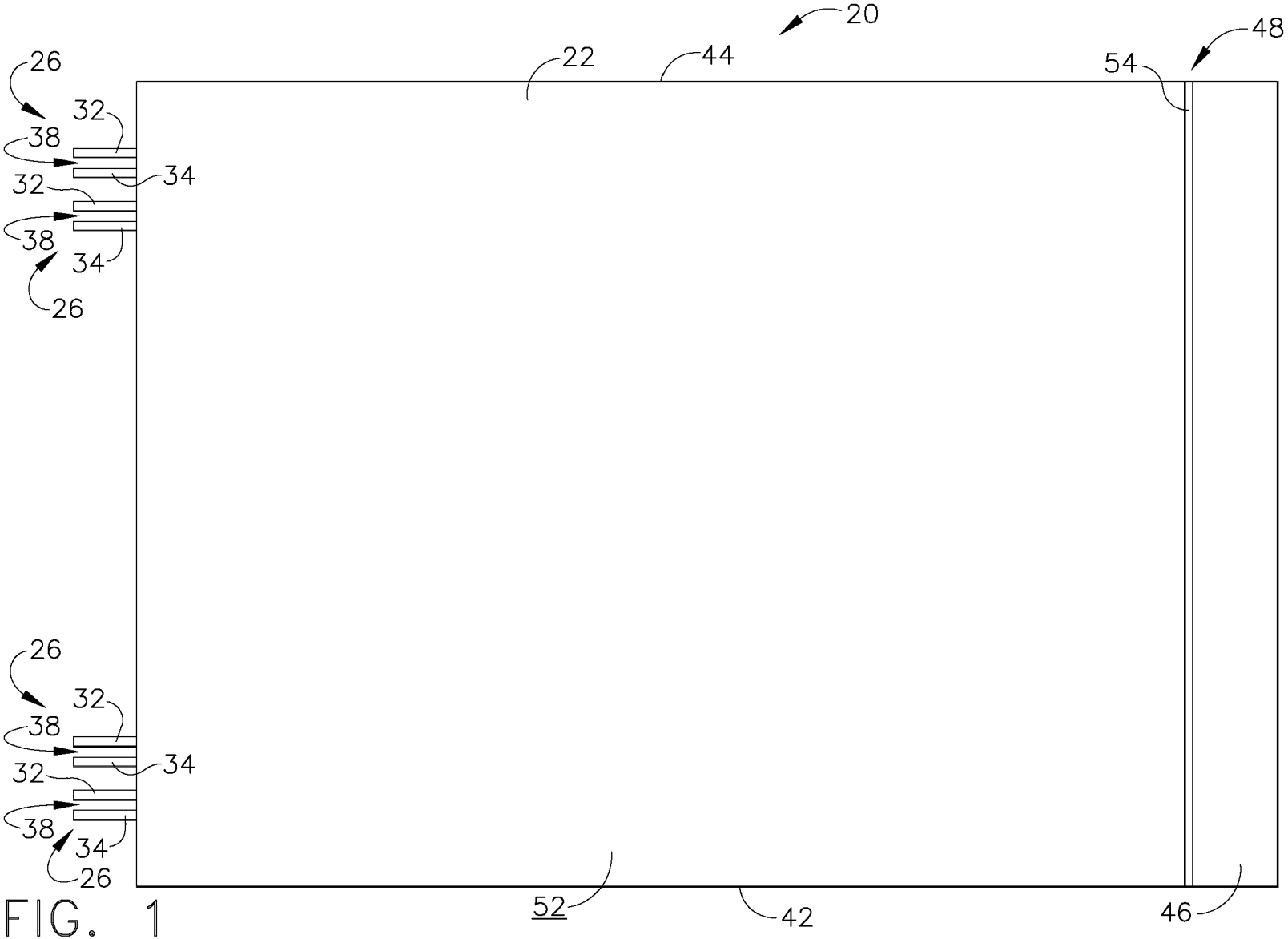
FIG. 1 is a front elevation view of a panel form in accordance with an embodiment of the present invention.

As indicated above, panel forms can be used to form erosion control fences or retaining walls, for example. Referring to FIGS. 1-4, panel form 20, a panel form in accordance with an embodiment of the present invention, can include body 22, first connectors 24, and second connectors 26. Body 22 can be configured to be positioned on, or adjacent to, the ground or, referring to FIGS. 5 and 6, configured to be at least partially inserted into, or buried in, the ground. In either event, panel form 20 can be mounted relative to the ground by mounts 28. In various embodiments, mounts 28 can be comprised of wood, plastic, and/or metal rods, such as No. 5 rebar, for example, which, as described in further detail below, can be inserted through apertures in first connectors 24 and second connectors 26 to mount panel form 20 relative to the ground. Mounting panel form 20 relative to the ground can include mounting panel form 20 directly to the ground or, more generally, fixing the position of mounting panel form 20 with respect to the ground. More particularly, in various embodiments, panel form 20 can be mounted on top of dirt piles, loose fill dirt, mulch piles, compost piles, or any other suitable material, in order to fix the position of panel form 20 relative to the ground.

Figure 3:
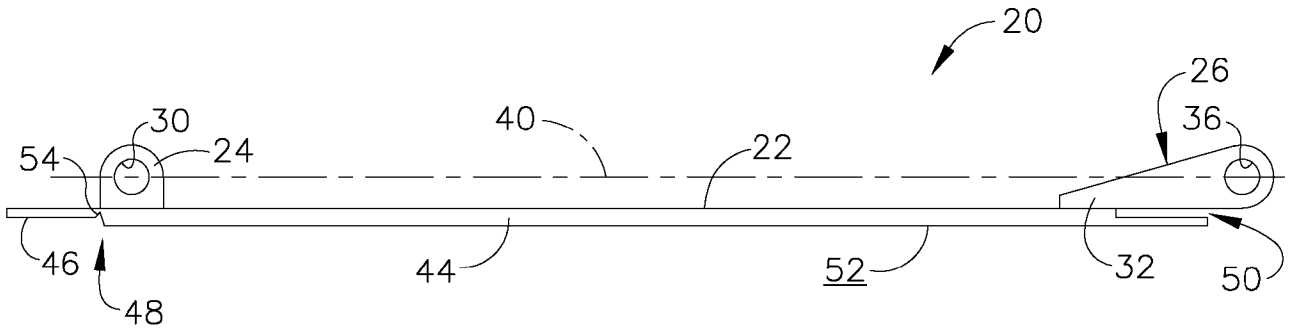
FIG. 3 is a top plan view of the panel form of FIG. 1.

Referring to FIG. 3, each first connector 24 can include an aperture 30 which can be sized and configured to receive a mount 28 therein. In the illustrated embodiment, apertures 30 can circumscribe the entire perimeter of a mount 28 inserted therein; however, other configurations of first connector 24 are possible. More particularly, in some embodiments, first connectors 24 can comprise hooks which extend from body 22 and substantially surround the perimeter of the mount 28. In at least one embodiment, panel form 20 can include a first connector 24 having at least one such hook and at least one first connector 24 as illustrated. Furthermore, although panel form 20 is illustrated as having four first connectors 24, and four second connectors 26, other suitable quantities are possible.

Referring to FIGS. 1-4, each second connector 26 can include a first projection 32 and a second projection 34, where, in the present embodiment, the first and second projections can each include an aperture 36 (FIG. 3) therein. Similar to apertures 30, apertures 36 can be sized and configured to receive a mount 28 therein. In the illustrated embodiment, apertures 36 can circumscribe the entire perimeter of a mount 28 inserted therein; however, other configurations of second connector 26 are possible. More particularly, similar to the above, second connectors 26 can comprise hooks which extend from body 22 and substantially surround the perimeter of the mount 28. In at least one embodiment, wherein at least some of first connectors 24 and second connectors 26 include hooks, the hooks can be configured such that they capture the panel form 20 to mounts 28 and prevent substantial lateral, or horizontal, movement of the panel form 20 with respect to mounts 28. In at least one embodiment, although not illustrated, panel form 20 can include additional connectors extending from body 22 intermediate first connectors 24 and second connectors 26 which are configured to receive a mount 28 therein. In such embodiments, these additional connectors can, in cooperation with mounts that have been inserted therethrough and driven into the ground, provide additional support to panel form 20.

Figure 2:
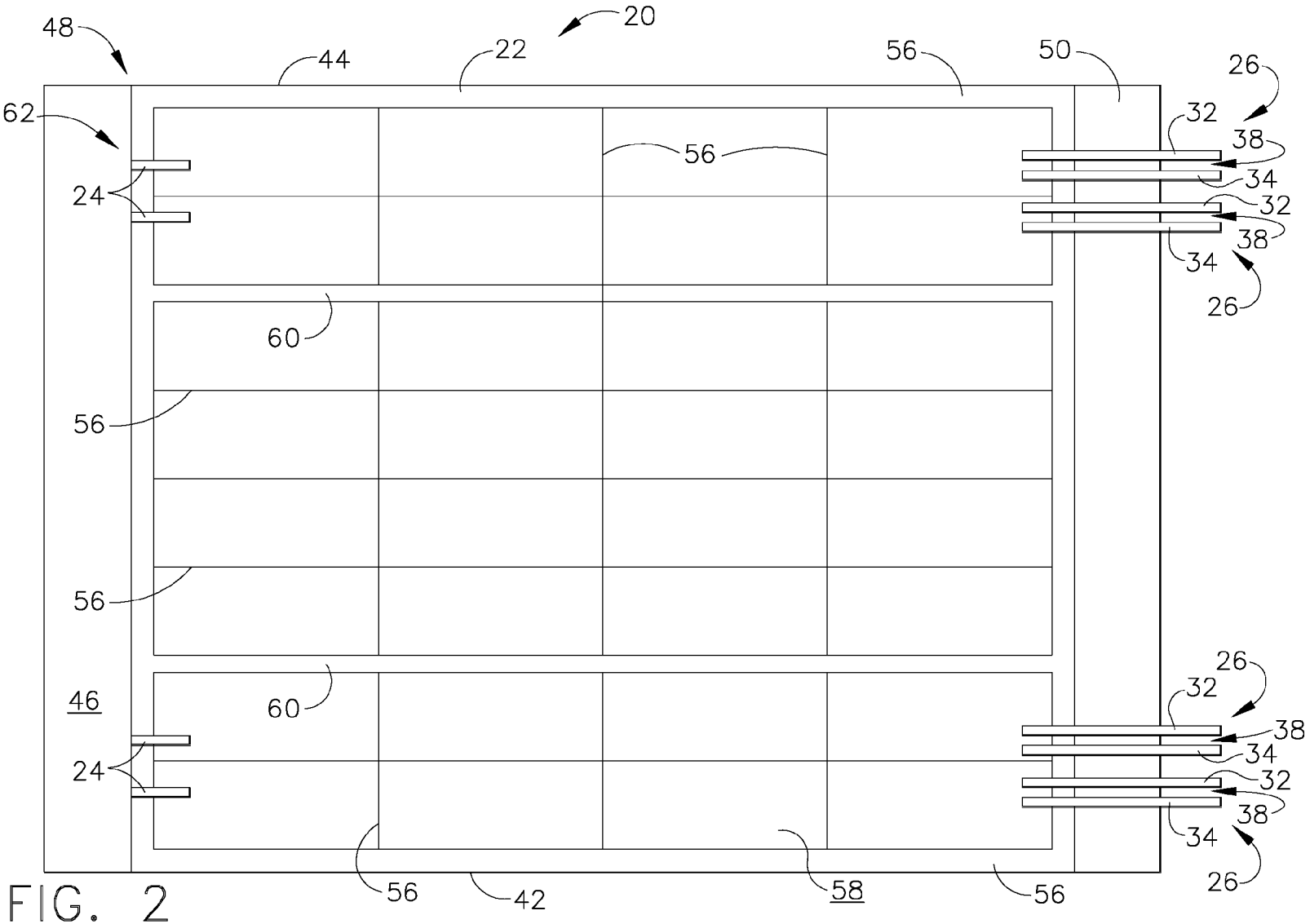
FIG. 2 is a rear elevational view of the panel form of FIG. 1.
Figure 4:
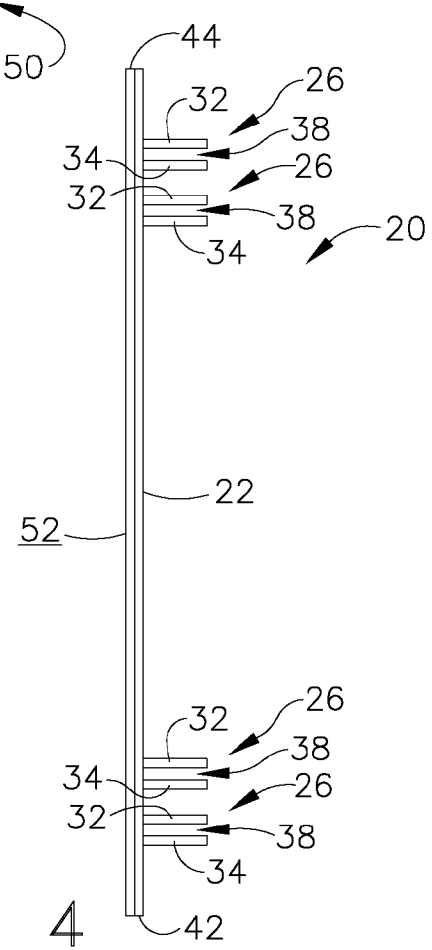
FIG. 4 is a side elevational view of the panel form of FIG. 1.

In various embodiments, referring to FIGS. 1, 2 and 4, first connectors 24 and second connectors 26 of adjacent panel forms 20 can be configured to form a hinge connection. In the illustrated embodiment, each second connector 26 can include a slot 38 intermediate first projection 32 and second projection 34. Each slot 38 can be sized and configured to receive at least a portion of a corresponding first connector 24 of an adjacent panel form 20 such that apertures 30 of first connectors 24 can be aligned with apertures 36 of second connectors 26 therein. In the illustrated embodiment, referring to FIGS. 1-3, second connector 26 can extend laterally with respect to the perimeter of panel mount 20 and, as a result, second connector 26 can extend behind an adjacent panel form 20 and be operably engaged with a first connector 24. More particularly, after the apertures have been aligned, a mount 28 can be inserted through apertures 30 and 36 such that the adjacent panel forms 20 are retained together. As first projections 32 and second projections 34 are disposed on opposite sides of each first connector 24, first connectors 24 and second connectors 26 can be interlocked such that the adjacent panel forms 20 are substantially unable to move vertically relative to each other. In various other embodiments, first connectors 24 can comprise two projections extending from body 22 having a slot therebetween which is sized and configured for receiving second connector 26.

Figure 5:
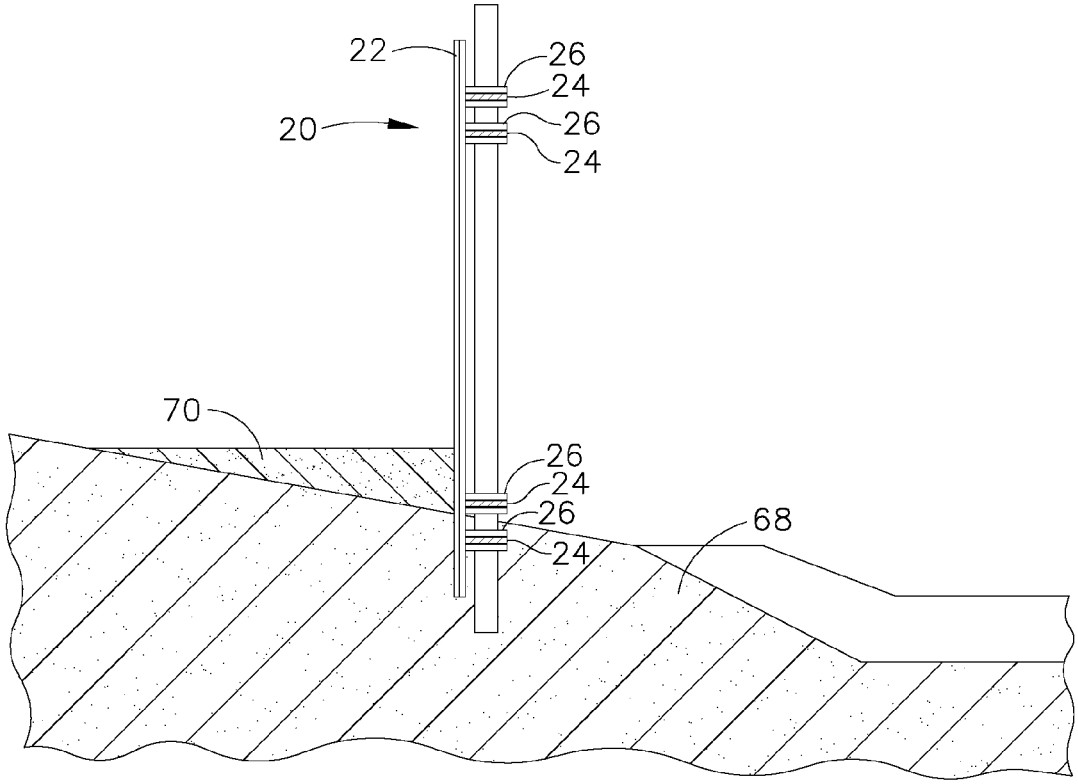
FIG. 5 is a schematic of the panel form of FIG. 1 mounted to the ground to form an erosion control fence in accordance with an embodiment of the present invention.
Figure 6:
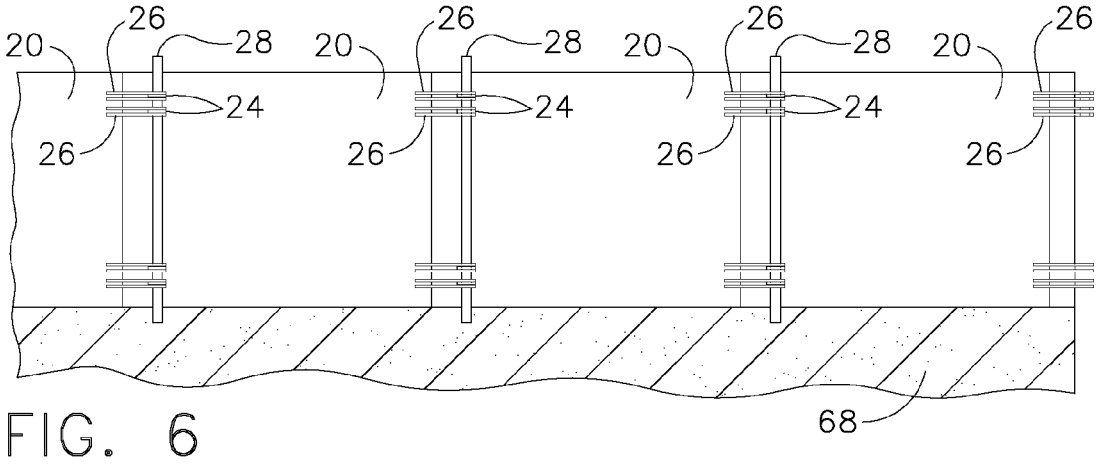
FIG. 6 is a schematic view of a plurality of the panel forms of FIG. 1 connected together and mounted to the ground in accordance with an embodiment of the present invention.

Referring generally to FIGS. 5 and 6, in order to assemble an embodiment of an erosion control fence or an embodiment of a retaining wall comprised of several panel forms 20, in various applications, adjacent panel forms 20 can be held in position while mounts 28 are inserted through connectors 24 and 26 and then driven into the ground. In these embodiments, as described above, the first connectors 24 of a first panel form 20 can be inserted into the second connectors 26 of a second panel form 20 such that apertures 30 of the first panel mount are aligned with apertures 36 of the second panel form before a mount 28 is inserted therethrough. Thereafter, the first connectors 24 of the second panel form can be aligned with second connectors 26 of a third panel form 20 before a mount 28 is inserted therethrough. This process can be repeated until a desired length of the erosion control fence or retaining wall has been realized. In various embodiments, panel forms 20 can have the same length or, in various embodiments, different lengths which can be selectively assembled together in order to achieve a desired length of the fence or wall, for example. In at least one such embodiment, a plurality of panel forms 20 can be provided having lengths of 1', 2', 3', and 4', for example, wherein the length of the wall or fence can be refined in 1' increments. In at least one embodiment, the "length" of each panel form 20 can be defined by the distance between the centers of apertures 30 and the centers of apertures 36.

In various embodiments, the orientation of each panel form 20 can be manipulated before it is mounted to the ground. More particularly, in at least one embodiment, after a mount 28 have been inserted through the first connectors of the first panel form 20 and the second connectors of the second panel form 20, and mounted to the ground, as described above, the second panel form 20 can be rotated with respect to the first panel form 20. In effect, the mount 28 can act as a hinge pin permitting relative hinged movement between the adjacent panel forms. Once the desired orientation of the second panel form 20 with respect to the first panel form 20 has been determined, a mount 28 can be inserted through the first connectors 24 of the second panel form 20 and, simultaneously, the second connectors 26 of the third panel form 20 and mounted to the ground. Thereafter, the orientation of the third panel form 20 can be rotated with respect to the second panel form 20 until the desired relative orientation therebetween is achieved.

In other various embodiments, the mounts 28 can be driven into the ground before the panel forms 20 are assembled thereto. In other various embodiments, it may be desirable to drive some, but not all, of the mounts, or supports, into the ground. In these embodiments, although not illustrated, a hinge pin may be inserted into relatively aligned first connectors 24 and second connectors 26 of adjacent panel forms 20 such that the panel mounts 20 are relatively rotatable but are not fixed to the ground by the hinge pin. In at least one embodiment, the hinge pin can include a flexible retention member which deflects as the hinge pin is being inserted into apertures 30 and 36 but resiliently expands to retain the hinge pin in the apertures once the retention member has passed therethrough. In various embodiments, erosion control fences, for example, can utilize such hinge pins to allow portions of the fences to flex when force is applied thereto. Furthermore, in at least one embodiment, first connectors 24 and second connectors 26 can be configured to form a hinged connection therebetween without the use of a mount, support, or hinge pin. In these embodiments, first connectors 24 and second connectors 26 can comprise co-operating features, such as a peg and a recess, for example, which can cooperate to permit relative rotational movement between adjacent panels 20.

For each panel form 20, referring to FIG. 3, apertures 30 of first connectors 24 and apertures 36 of second connectors 26 can define an axis, i.e., axis 40, therebetween. In at least one embodiment, axes 40 of adjacent panel forms 20 can be aligned such that they are substantially collinear. In these embodiments, a plurality of panel forms 20 can comprise a fence or retaining wall which is substantially linear. Alternatively, in other embodiments, axes 40 of adjacent panel forms 20 can be transverse to each other and define an angle therebetween. In at least one embodiment, axes 40 of two adjacent panels can be substantially perpendicular, i.e., they can define an angle therebetween which is substantially 90 degrees. In these embodiments, the panel forms can, referring to FIGS. 7 and 8, form retention walls having substantially right angle corners, for example. However, in other embodiments, angles defined between axes 40 of adjacent panel forms 20 can be less than 90 degrees or greater than 90 degrees. In various embodiments, a fence or retaining wall can include a plurality of panel forms 20 which are oriented at the same angle, or several different angles, relative to each other. In at least one embodiment, a lock member (not illustrated) can be engaged with the adjacent panel forms 20 to hold or lock the panels in position relative to each other. In one such embodiment, a plurality of lock members can be provided which are configured to hold or lock the panels in one of several preferable, or commonly-used, angles including, but not limited to, 15°, 30°, 45°, 60°, 90°, 105°, 120°, and 135°. Such lock members may be configured to slidably engage portions of adjoining panels. However, other fastener arrangements such as, for example, screws, adhesive, etc. could be successfully employed.

As discussed above, panel form 20 can, in various embodiments, be positioned on or above the ground. In at least one embodiment, at least a portion of panel form 20 can be recessed into the ground. In various embodiments, a trench can be dug which is configured to receive at least a portion of panel form 20 and receive backfilled dirt to assist in securing panel form 20 in the ground. In at least one embodiment, at least a portion of panel form 20 can be pushed into the ground. In these embodiments, referring to FIG. 1, panel form 20 can include a bottom edge 42 which is configured in the form of a wedge (not illustrated), for example, which can facilitate the insertion of panel form 20 into the ground and retention therein. Furthermore, in these embodiments, panel form 20 can include a top edge 44 which includes a flat portion (not illustrated), for example, which is configured to receive an installation force thereupon to drive the panel forms into the ground. In embodiments where panel forms 20 of an erosion control fence are recessed into the ground, the fence may be able to better retain heavier loads of dirt or mud therebehind, for example.

In addition to the above, as a result of recessing at least a portion of panel forms 20 into the ground, less dirt or mud can flow underneath panel forms 20 than when they are positioned on top of the ground. This benefit is particularly advantageous when panel forms 20 comprise an erosion control fence on a construction site proximal to a road or stream, for example. More particularly, in these circumstances, regulations often limit, or prohibit, the flow of sediment onto a road or into a stream from a construction site and, thus, it is often advantageous to reduce the flow of sediment, or water containing sediment, therefrom. In various embodiments, panel forms 20 can further include features which reduce, or possibly eliminate, the flow of sediment between adjacent panel forms 20. Referring to FIGS. 1-4, panel form 20 can include tab 46 (FIG. 2) extending from body 22 and can, in various embodiments, extend along the entire side 48 of panel form 20. Referring primarily to FIG. 3, panel form 20 can further include slots 50 which, in the illustrated embodiment, are defined between portions of second connectors 26 and body 22. In use, slots 50 can be configured to receive at least a portion of a tab 46 of an adjacent panel form 20 such that the front surfaces 52 of the adjacent panel forms 20, in combination with tabs 46, comprise a substantially continuous wall. Stated another way, tabs 46 can extend between adjacent panel forms 20 such that there is no linear flow path between the adjacent panel forms. As a result, tabs 46 can cooperate with adjacent panel forms 20 to at least impede, if not substantially prevent, the flow of sediment, or water containing sediment, between adjacent panel forms 20. If desired, a commercially available sealant or adhesive material may be applied to tab 46 to obtain a substantially fluid tight seal between panel forms.

Figure 11:
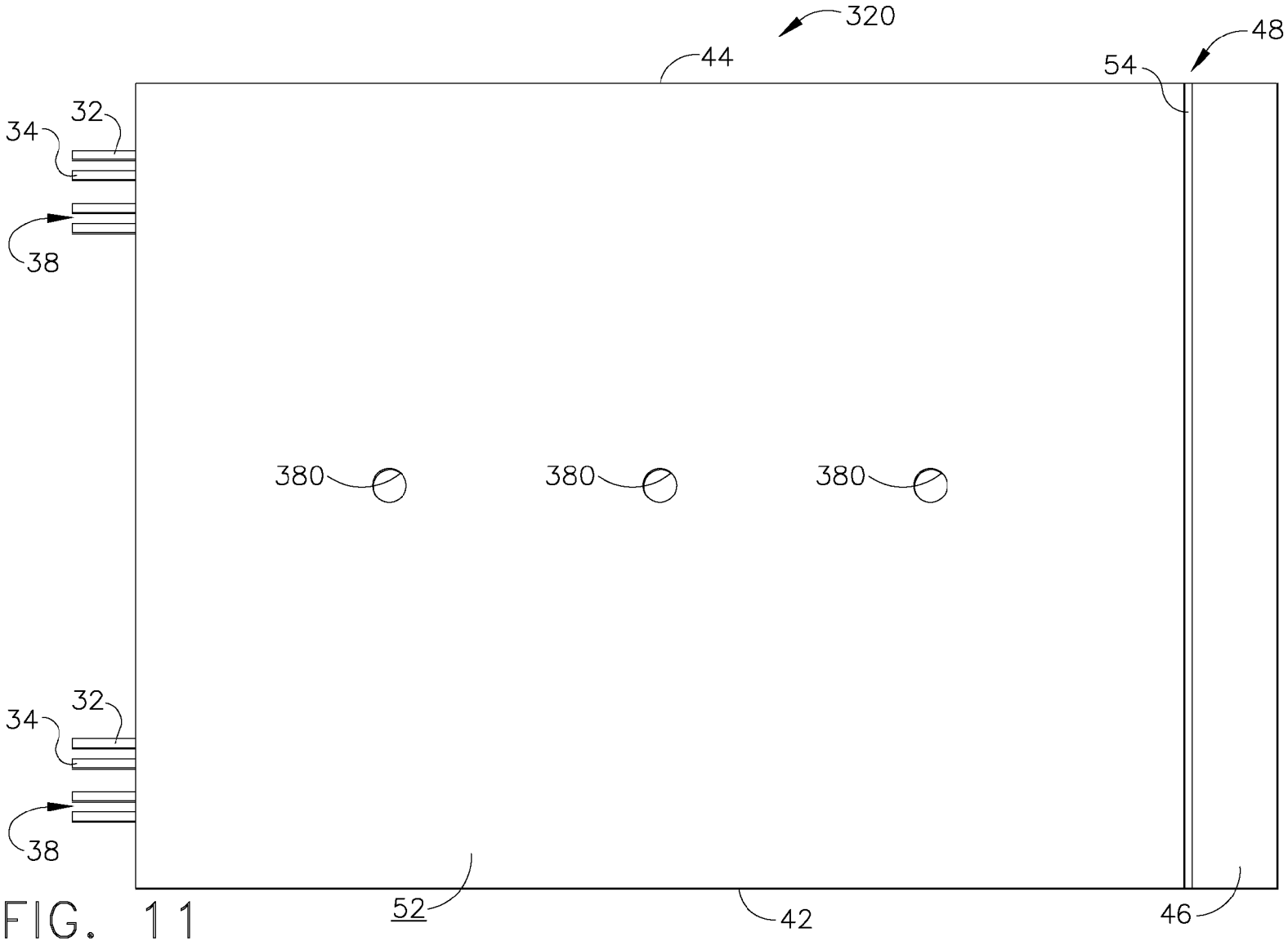
FIG. 11 is a front elevation view of a panel form in accordance with an alternative embodiment of the present invention.
Figure 12:
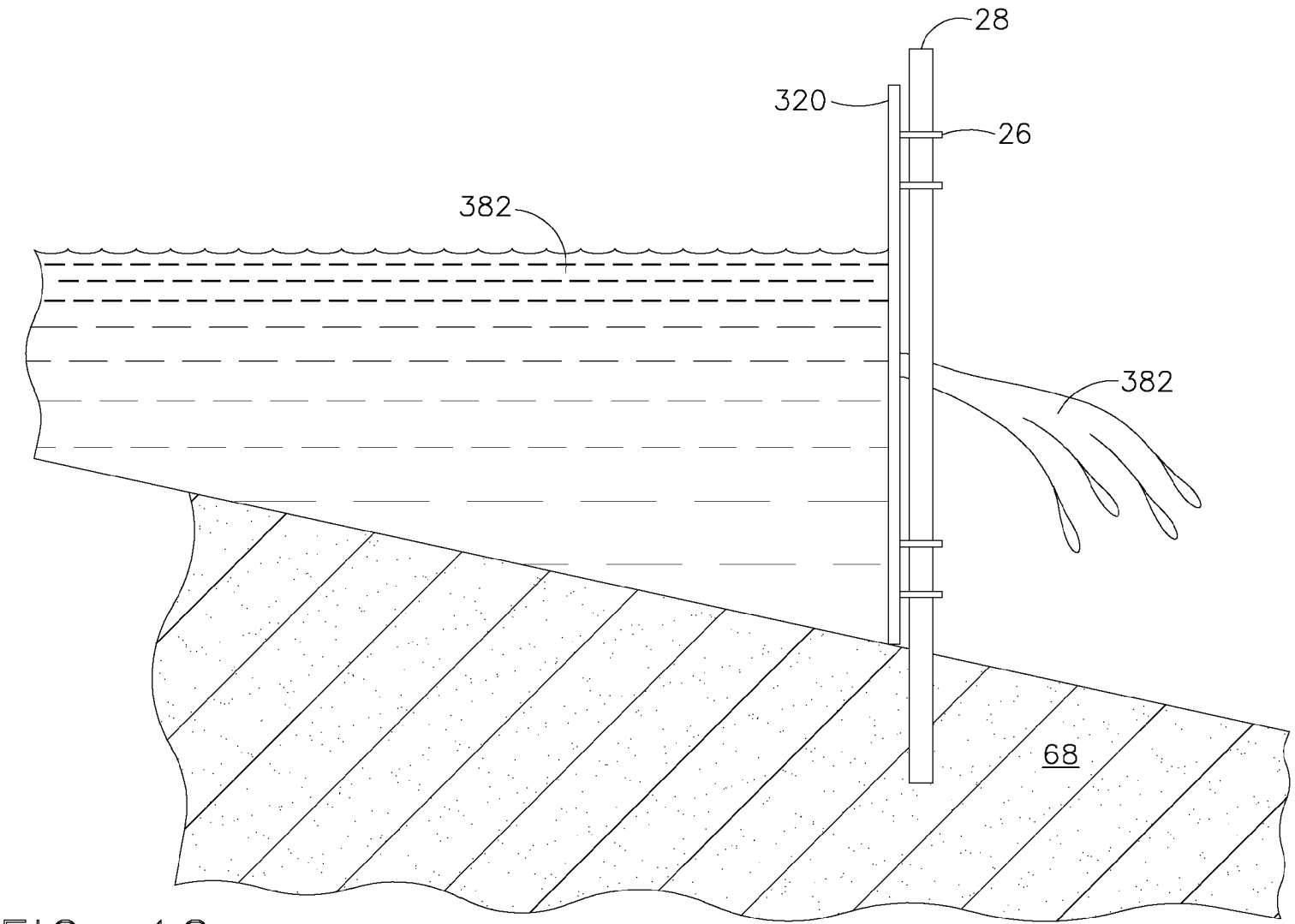
FIG. 12 is a schematic of the panel form of FIG. 11 mounted to the ground to form a water control fence in accordance with an embodiment of the present invention.

As described above, referring to FIGS. 5 and 6, panel forms 20 can be used to retain eroded soil, such as eroded soil 70, therebehind, for example. In various embodiments, especially in embodiments where ground 68 is downwardly sloping, panel forms 20 can retain soil 70 in a ditch, or trough, extending between panel forms 20 and ground 68. In various embodiments, as a result of the cooperation of slots 50 and tabs 46, panel forms 20 can be used to retain water, or another fluid, therebehind. In these embodiments, a fence comprised of panel forms 20 can substantially prevent a sudden discharge, or spill, of fluid on a construction site from flowing off of the site, for example. In addition, in various embodiments, slots 50 and/or tabs 46 can include a compressible material thereon (not illustrated) which is configured to create a seal between slots 50 and tabs 46. In these embodiments, the compressible material can create a seal between the surfaces of tabs 46 and slots 50 to further impede, or even stop, the flow of sediment, and/or water, thereby. In either event, panel forms 20 can be configured to retain a significant quantity of water therebehind. In these embodiments, the water can be slowly released over the tops of panel forms 20 and/or through any gaps under or between the panel forms 20. In other embodiments, referring to FIGS. 11 and 12, it may be desirable to provide drain holes, for example, through the panel at a desired distance above the ground. These holes, such as holes 380 in panels 320, can be made either when panels 320 are manufactured or at the job site through the use of power or hand tools. As a result, panel forms 320, in these embodiments, can provide a controlled release of rain water runoff 382 after a storm, for example.

In various embodiments, referring to FIGS. 1 and 3, tab 46 can be connected to body 22 by a hinge. In at least one embodiment, the hinge can include "living" hinge 54. Living hinge 54 can include, in various embodiments, a thin strip of material which permits tab 46 to be rotated relative to body 22 about a vertical axis defined by living hinge 54. In at least one embodiment, living hinge 54 can include a strip of material which is thinner than body 22 and/or tab 46. In these embodiments, as a result, living hinge 54 can permit tab 46 to be rotated with respect to body 22 without either of tab 46 and body 22 yielding or otherwise permanently deforming. In at least one embodiment, living hinge 54 can be comprised of an elongate notch, including a V-shaped notch, for example, extending between bottom edge 42 and top edge 44 of body 22. In various embodiments, tab 46, body 22 and living hinge 54 can comprise a unitary structure which is formed by a plastic injection molding process, for example. In other various embodiments, although not illustrated, tab 46 and body 22 can be assembled together by a hinge pin which is inserted into receiving portions extending along adjacent edges of tab 46 and body 22, for example.

Regardless of the type of hinge connecting tab 46 and body 22, the hinge can facilitate relative movement between adjacent panel forms 20. More particularly, after tab 46 of a first panel form 20 has been inserted into slots 50 of an adjacent panel form 20, the hinge can permit relative rotational movement between the panel forms 20 eventhough tab 46 is retained within slots 50. In use, in at least one such embodiment, a mount 28 can be inserted through the first connectors 24 of the first panel mount 20 to secure the first panel form 20 to the ground. The tab 46 extending from the adjacent panel form 20 can be inserted into the slots 50 of the first panel form 20 such that the first connectors 24 of the adjacent panel form 20 are aligned with the second connectors 26 of the first panel form 20. Thereafter, as described above, a mount 28 can be inserted through connectors 24 and 26 and be driven into the ground. However, as a result of the hinge connecting tab 46 to body 22 of the adjacent panel form 20, the adjacent panel form can be rotated with respect to the first panel form 20 eventhough the tab 46 of the adjacent panel mount 20 is retained in the slots 50 of the first panel form 20. Accordingly, adjacent panel forms 20 can be mounted to the ground in different orientations yet still have a continuous wall therebetween owing to the cooperation of tab 46 and its corresponding hinge.

In various embodiments, referring to FIG. 2, body 22 can include ribs, or other features, for strengthening panel form 20. More particularly, in at least one embodiment, body 22 can include ribs 56 which extend from rear surface 58 and increase the cross-sectional thickness of some portions of body 22. Accordingly, ribs 56 can stiffen panel mount 20 and thereby decrease the amount by which panel form 20 will deflect under load. In at least one embodiment, the quantity, size, and location of ribs 56 can be selected to control the stiffness of panel form 20. In general, larger, and/or thicker, ribs 56 can stiffen panel mount 20 more than smaller, and/or thinner, ribs 56. Furthermore, in general, greater densities of ribs 56, i.e., the quantity and location of ribs 56, can stiffen panel mount 20 more than lesser densities of ribs 56. In at least one embodiment, ribs 56 can comprise a symmetric array on panel mount 20 such that panel form 20 will deflect in a substantially uniform manner. However, in other embodiments, ribs 56 can be configured to stiffen panel mount 20 more in some portions, but less in others. In these embodiments, the panel form 20 can be configured to deflect in an asymmetrical manner. In at least one embodiment, although not illustrated, front surface 52 can include ribs, or other features, to stiffen panel mount 20. In various embodiments, panel forms 20 can include recesses (not illustrated) which can selectively weaken panel forms 20.

As described above, panel forms 20 and mounts 28 can be quickly and easily assembled and mounted to the ground; however, they can also be quickly and easily be disassembled and removed from the ground as well. More particularly, in various embodiments, an erosion control fence comprised of panel forms 20, as described above, can be disassembled by pulling mounts 28 out of the ground and collecting the now unconnected panel forms 20, for example. In other embodiments, the panel forms 20 may be slid upward with respect to the mounts 28 until the panel forms 20 are no longer connected thereto. In embodiments where the panel forms 20 are connected together, as described above, several panel forms 20 may have to be removed simultaneously. However, in embodiments where mounts 28 include a head or bent portion at its top, the panel forms 20 may not be able to be slid upward with respect to mounts 28. In either event, once panel forms 20 and mounts 28 have been disassembled, they, in various embodiments, can be reused and reassembled to form a substantially similar fence or a fence having a different configuration altogether. Accordingly, the adaptability and reusability of these components, for example, is a significant improvement over the existing silt fences described above.

Figure 10:
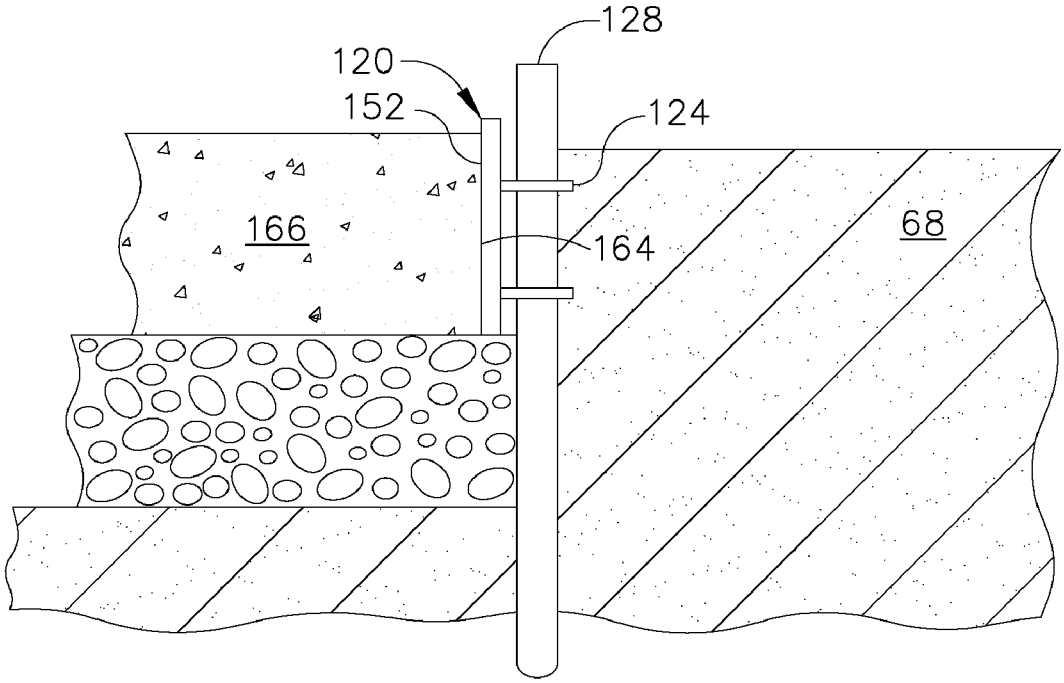
FIG. 10 is a schematic view of a panel form in accordance with an alternative embodiment of the present invention being used to define and form the edge of poured concrete.

As described above, several panel forms can be provided having different lengths; however, in addition, several panel forms can be provided having different heights, i.e., different distances between bottom edge 42 and top edge 44. In various embodiments, the length, height, and width of the panel forms can be selected to facilitate their use in any suitable application. In some embodiments, for example, the panel forms can be approximately 24" long, 4.5" high, and 0.25" thick. Such embodiments can be useful for forming concrete edges, for example. More particularly, in various embodiments, referring to FIG. 10, panel forms 120 can be used to form concrete edges 164. Stated another way, panel forms 120 can define and form the edges of poured concrete 166 such that, after the concrete has at least partially cured, panel forms 120 can be removed from concrete 166 leaving behind a clearly defined edge 164 of the concrete. In various embodiments, panel forms 120, depending on the stiffness thereof, can be resiliently bent to define arcuate shapes and then staked into place by concrete pins 128 inserted through first connectors 124 and second connectors 126 (not illustrated) of panel forms 120.

Panel forms 120, as used in the above applications, can provide a significant improvement over previous concrete forms which typically included straight wood beams and makeshift curved portions comprised of typically ill-suited materials which were known to deteriorate quickly and were often unreusable. However, panel forms 120 can, in various embodiments, be easily removed from concrete 166 and reused to form concrete edges having the same profile, or a different profile, as the panel forms are flexible and can be resiliently bent into a variety of suitable arcuate configurations. In various embodiments, panel forms 120 can be comprised of plastic, for example, where, in various embodiments, front surface 152 is substantially smooth and can be quickly wiped, or scraped, clean before it is used again. Furthermore, in various embodiments, the cooperating tabs and slots described above can be configured to provide a substantially seamless concrete edge as the gaps between adjacent panel forms 120 can be minimized, as described above.

Figure 9:
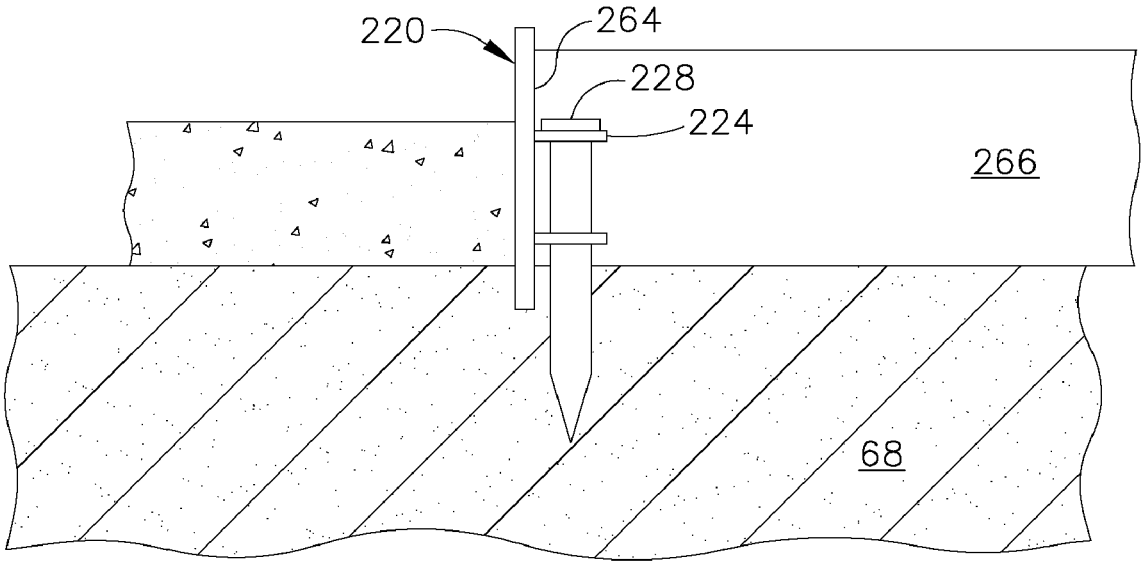
FIG. 9 is a schematic view of a panel form in accordance with an alternative embodiment of the present invention being used to define a landscaping edge.

In other various embodiments, similar to the above, panel forms 220, referring to FIG. 9, can be used to define and form landscaping edges 264. In these embodiments, panel forms 220 can be flexible enough to define and form arcuate edges yet strong enough to reliably retain landscaping materials, such as mulch 266, for example, therebehind. In various embodiments, similar to the above, at least a portion of panel forms 220 can be recessed into ground 68 and be mounted thereto with galvanized deck spikes 228, for example. As above, the length, height and thickness of the panel forms can be selected to suit these particular applications. In at least one alternative embodiment, the panel form 20 illustrated in FIGS. 1-4 can be modified to provide suitable panel forms for the present application. More particularly, referring to FIG. 2, panel form 20 can be cut along ribs 60 to create panel form portions 62 which can be used to form landscaping edges 264. In these embodiments, each panel form portion 62 could include at least some first connectors 24 and second connectors 26 which can cooperate to form the hinged connections described above. Furthermore, in these embodiments, each panel form portion 62 could include at least a portion of tab 46 and at least some slots 50 which can cooperate to form a continuous wall as described above.

Figure 7:
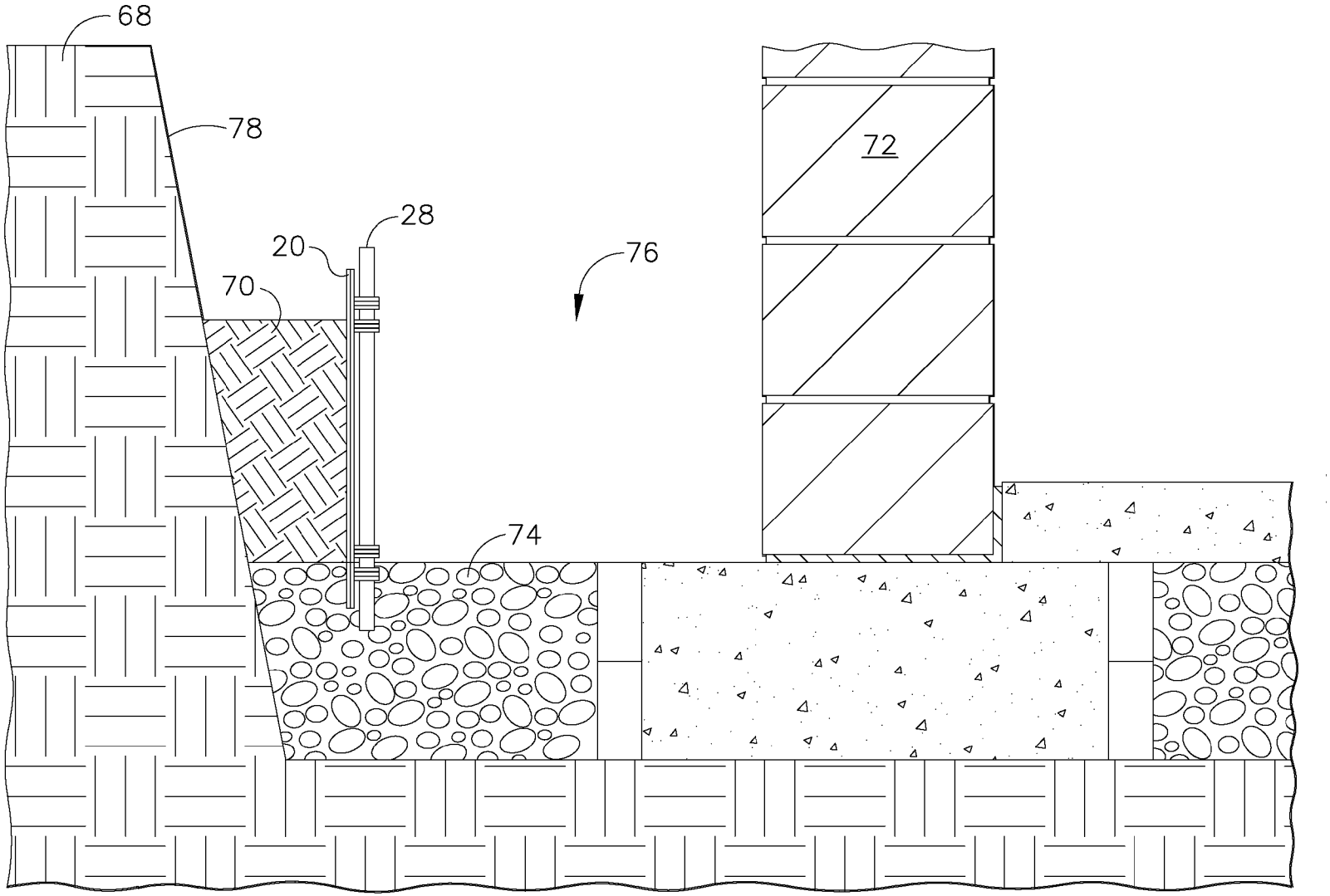
FIG. 7 is a schematic view of the panel form of FIG. 1 being used to prevent dirt or mud from flowing onto a footer drain surrounding a building foundation in accordance with an embodiment of the present invention.
Figure 8:
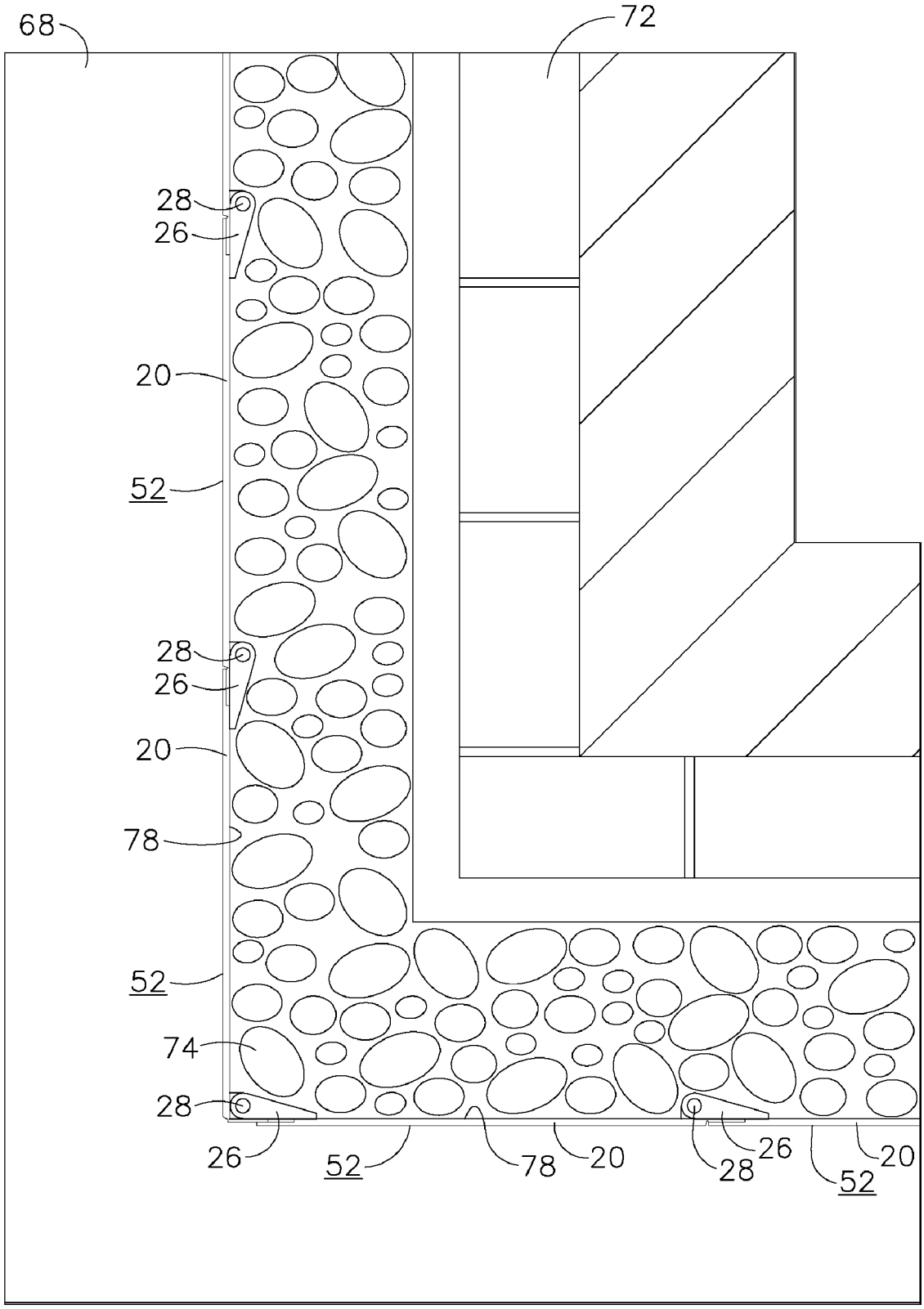
FIG. 8 is a schematic view of a plurality of panel forms of FIG. 1 being used to retain the dirt wall of a ditch surrounding a building foundation.

As mentioned above, and as discussed in greater detail below, referring to FIGS. 7 and 8, panel forms in accordance with the present invention can be used to protect the footer drains of a building while it is being constructed. More particularly, after foundation 72 of the building has been constructed, small stones 74, such as gravel, for example, can be placed in ditch 76 which surrounds foundation 72 to create a footer drain. As known in the art, a footer drain can be used to reduce hydrostatic pressure against foundation 72 as stones 74 can permit water to percolate therethrough and flow away from foundation 72. However, if the small stones 74 are clogged with dirt or mud, for example, water may not be able to flow away from foundation 72 thereby allowing hydrostatic pressure to build against the foundation. In various circumstances, as described above, dirt or mud from walls 78 of ditch 76 can slide down on top of stones 74 during the construction of the building before ditch 76 can be properly backfilled. In various embodiments of the present invention, panel forms 20 can be mounted into ditch 76 to substantially prevent dirt and mud from clogging stone 74. More particularly, in at least one embodiment, panel forms 20 can be mounted in ditch 76 such that a gap between panel forms 20 and ditch walls 78 can be configured to substantially retain dirt or mud 70 therebetween. In other embodiments, referring to FIG. 8, panel forms 20 can be mounted in ditch 76 such that they are positioned against, or abutting, dirt walls 78. In either event, panel forms 20 can reduce, or even prevent, dirt or mud from sliding onto stones 74 and clogging the footer drain as described above.

Figure 13:
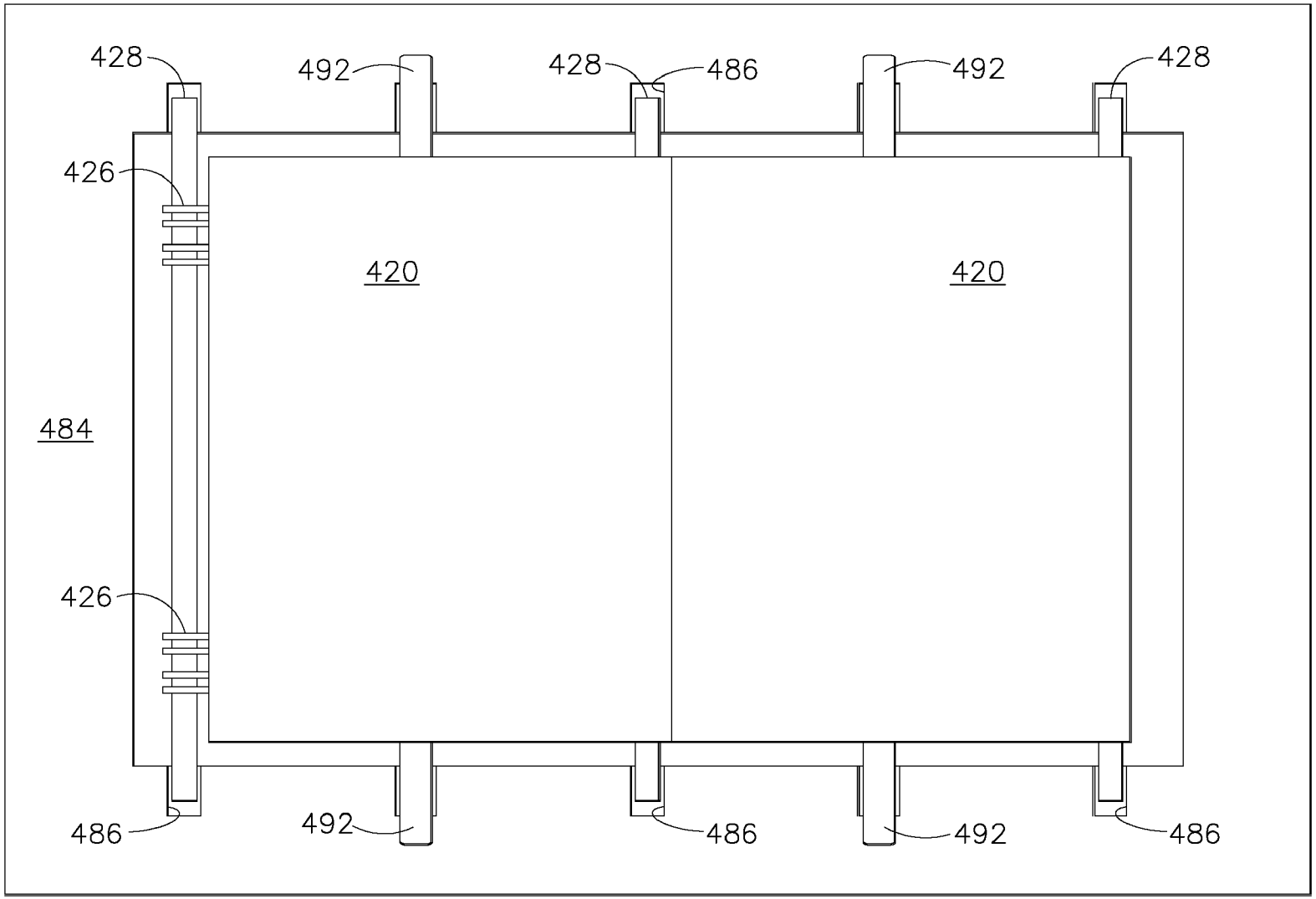
FIG. 13 is a plan view of panel forms in accordance with an embodiment of the present invention positioned within storm inlet boxes.
Figure 14:
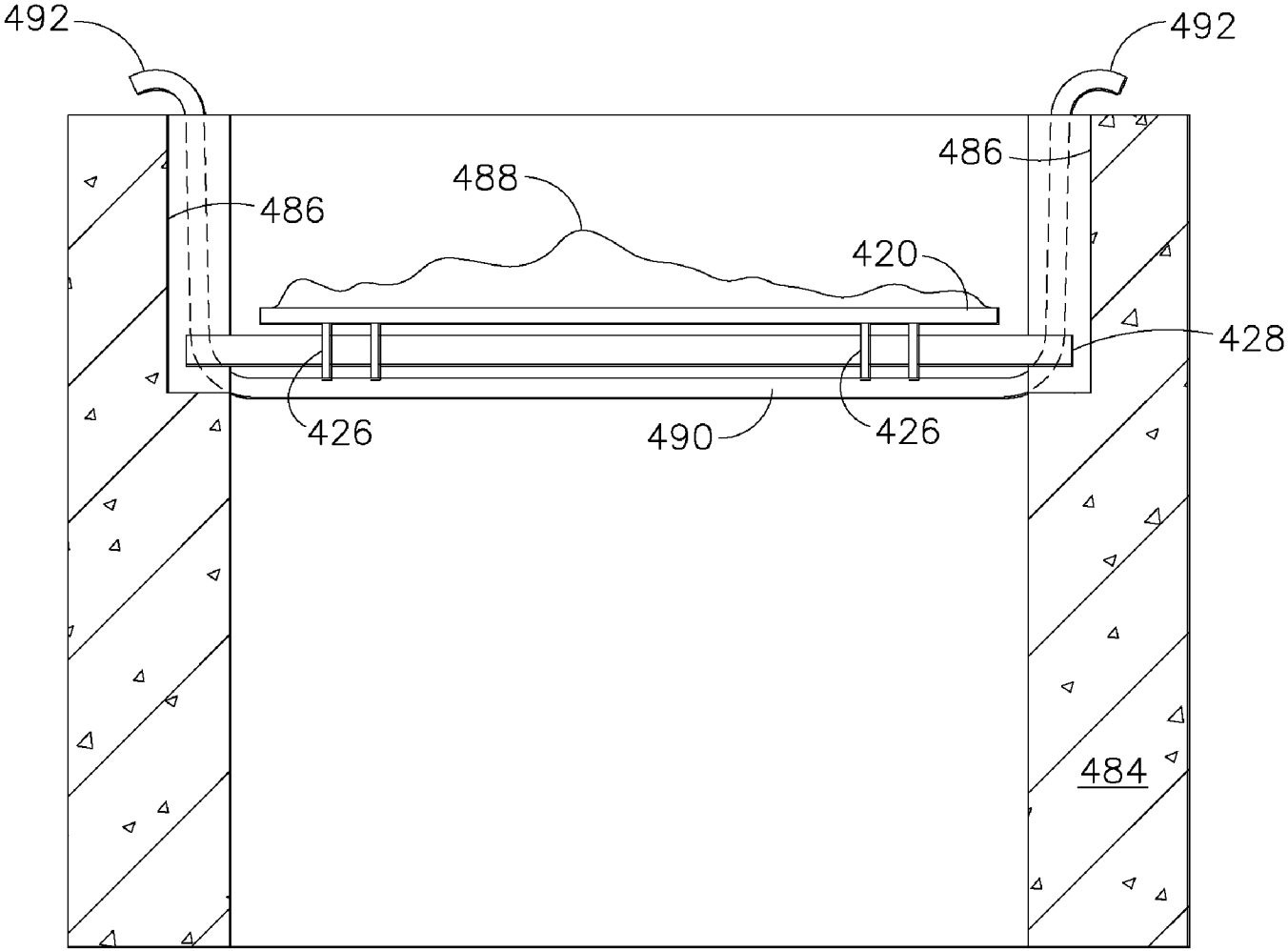
FIG. 14 is an elevational view of the panel forms and the storm inlet box of FIG. 13 with portions shown in cross-section.

Panel forms in accordance with an embodiment of the present invention can also be used to limit the flow of sediment, for example, into storm drains. More particularly, storm drains for a new building are typically installed prior to the completion of the building and, owing to excavation at the construction site, for example, significant quantities of dirt can flow into the storm drains causing blockages or other deleterious effects to the storm drains. To reduce or prevent dirt from flowing into such storm drains, referring to FIGS. 13 and 14, panel forms can be inserted into the storm drain inlet boxes. In the illustrated embodiment, storm drain inlet box 484 can include a poured concrete body having recesses 486 therein configured to receive supports 428. In use, as illustrated in FIG. 13, panel forms 420 can be interconnected, similar to the above, by supports 428 to form a substantially continuous retaining surface configured to stop the progression of dirt 488, for example, into a storm drain positioned below inlet box 484. In various embodiments, the assembly can further include at least one filter bag configured to capture sediment entering into the inlet box. In various embodiments, referring to FIG. 14, filter bag 490 can be positioned beneath panel forms 420 to capture the flow of sediment thereby. In other embodiments, filter bag 490 can be positioned on top of panel forms 420 or, in alternative embodiments, panel forms 420 can be positioned within filter bag 490. In either event, filter bag 490 can include straps 492 which can extend outside of the drain inlet box so that the panel forms, supports, and filter bag can be lifted out of the inlet box. In various embodiments, although not illustrated, the assembly may further include washers, or adapters, positioned on supports 428 so that supports 428 may be securely positioned within recesses 486. In at least one such embodiment, the adapters may be resilient to securely hold supports 428 in position.

Panel forms in accordance with the present invention can be comprised of various materials such as wood, plastic and/or foam-based materials, for example. In at least one embodiment, the panel forms may be comprised of polymers and can be manufactured via a plastic injection molding process. In one such embodiment, the polymers, such as polypropylene, for example, can be largely water resistant, i.e., hydrophobic. In these embodiments, the panel forms can be stored outside without significant water damage thereto. However, in other embodiments, the polymers can absorb water. In these embodiments, water can cause at least portions of the panel form 20 to swell and create a better seal, or reduce gaps between, adjacent panel forms. In various embodiments, glass fibers, carbon fillers, and/or talc powder can be mixed with the polymers to strengthen, or stiffen, the panel form. In at least one embodiment, a colorant, or colorants, can be added to the polymer to alter the color of the panel forms. In these embodiments, the panel forms can be colorized such that they are green or brown, for example, and can blend in with the surrounding environment. In other various embodiments, the panel forms can be configured to be painted or receive a sticker thereon, for example, which displays an advertisement. Such embodiments are particularly advantageous when the panel forms are used at construction sites in residential, commercial or industrial areas. In some embodiments, the panel forms, and/or mounts, can be comprised of a biodegradable material which can deteriorate over time possibly obviating the need to retrieve the panel forms and mounts. Such embodiments are particularly advantageous when the panel forms are used in remote locations which make removal thereof impractical or inconvenient, for example.

While this invention has been described as having exemplary designs, the present invention may be further modified within the spirit and scope of the disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A panel, comprising:

a front surface;

a rear surface;

a first connector portion;

a second connector portion, wherein said second connector portion is configured to be operably engaged with a said first connector portion of an adjacent panel to permit relative hinged movement between said panel and the adjacent panel;

a tab extending from said panel;

a hinge connecting said tab to said panel; and a slot configured to receive a said tab extending from the adjacent panel.

2. The panel of claim 1, wherein said slot is defined between at least a portion of said second connector portion and said rear surface.

3. The panel of claim 1, wherein said hinge includes a strip of material having a thickness less than the thickness of said panel.

4. The panel of claim 1, wherein said tab is configured to be received in a slot in an adjacent panel such that said tab, said front surface of said panel, and the front surface of the adjacent panel form a continuous wall.

5. The panel of claim 1, wherein said first connector portion includes a first aperture configured to receive a first mount, wherein said first mount is configured to mount said panel relative to the ground, wherein said second connector portion includes a second aperture configured to receive a second mount, and wherein said second mount is configured to mount said panel relative to the ground.

6. The panel of claim 5, wherein said first aperture and said second aperture define an axis therebetween, and wherein, when said tab is positioned within a said slot of an adjacent panel, said hinge permits said panel to be mounted relative to the ground in an orientation in which said axis of said panel is not parallel to or collinear with a said axis of the adjacent panel.

7. The panel of claim 6, wherein said axis of said panel and the axis of the adjacent panel define an angle therebetween.

8. The panel of claim 7, wherein said angle is greater than zero degrees and is less than 180 degrees.

9. The panel of claim 7, wherein said angle is substantially 90 degrees.

10. The panel of claim 1, wherein said second connector portion includes a first projection and a second projection extending from said panel, and wherein said first and second projections define a slot therebetween configured to receive at least a portion of the first connector portion extending from the adjacent panel.

11. The panel of claim 1, wherein said panel further comprises a perimeter defined by said rear surface, wherein said first connector portion extends from said rear surface, wherein said second connector portion extends laterally with respect to said perimeter, and wherein said second connector portion is configured to extend behind the rear surface of the adjacent panel and be hingedly connected to the first connector portion of the adjacent panel by a mount.

12. A panel, comprising:

a first connector configured to receive a first mount, wherein said first connector is configured to be operably engaged with the first mount and a connector extending from a first adjacent panel to comprise a first hinge connection; and a second connector configured to receive a second mount, wherein said second connector is configured to be operably engaged with the second mount and a connector extending from a second adjacent panel to comprise a second hinge connection;

wherein the first mount is configured to mount said panel relative to the ground, wherein the first adjacent panel can be rotated with respect to said panel about the first mount before it is mounted relative to the ground, and wherein the second adjacent panel can be rotated with respect to said panel about the second mount before it is mounted relative to the ground, and wherein said panel further comprises:

a front surface;

a rear surface, a first end adjacent to said first connector;

a tab extending from said first end;

a hinge connecting said tab to said panel; and a slot configured to receive a said tab extending from the second adjacent panel.

13. The panel of claim 12, wherein said second connector includes a first projection and a second projection extending from said panel, wherein said first and second projections define a slot therebetween, and wherein said slot is configured to receive at least a portion of the connector extending from the second adjacent panel.

14. The panel of claim 12, wherein said first connector and said second connector extend from said rear surface.

15. The panel of claim 12, wherein said panel further comprises:

a perimeter defined by said rear surface, wherein said second connector extends laterally with respect to said perimeter, and wherein said second connector is configured to extend behind the rear surface of the second adjacent panel and be hingedly connected to the connector extending therefrom by the second mount.

16. The panel of claim 12, wherein said slot is defined between at least a portion of said second connector and said rear surface.

17. The panel of claim 16, wherein said hinge includes a strip of material having a thickness less than the thickness of said panel and the thickness of said tab.

18. A panel, comprising:

first connection means for hingedly connecting said panel to a first adjacent panel;

second connection means for hingedly connecting said panel to a second adjacent panel;

receiving means for receiving a portion of said second adjacent panel;

a tab extending from said panel, wherein said tab is configured to be received within receiving means of the first adjacent panel; and hinge means for connecting said tab and said panel and permitting relative hinged movement between said tab and said panel, wherein the first adjacent panel can be rotated relative to said panel when said tab is received within the receiving means of the first adjacent panel.

19. A panel, comprising:

a panel body;

first connection means for hingedly connecting said panel body to a first adjacent panel;

second connection means for hingedly connecting said panel body to a second adjacent panel;

receiving means for receiving a portion of said second adjacent panel;

a tab extending from said panel body, wherein said tab is configured to be received within receiving means of the first adjacent panel; and hinge means for connecting said tab and said panel body and permitting relative hinged movement between said tab and said panel body, wherein the first adjacent panel can be rotated relative to said panel body when said tab is received within the receiving means of the first adjacent panel.

* * * * *